US007104842B1

(12) United States Patent
Huang et al.

(10) Patent No.: US 7,104,842 B1
(45) Date of Patent: Sep. 12, 2006

(54) ELECTROMAGNETIC INTERFERENCE DIMINISHING STRUCTURE OF A CONNECTOR ASSEMBLY

(75) Inventors: Ching-Hsiung Huang, Hsi-Chih (TW); Hung-Ming Chen, Taipei (TW)

(73) Assignee: Joinsoon Electronics Mfg. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/315,497

(22) Filed: Dec. 23, 2005

(30) Foreign Application Priority Data

Nov. 24, 2005 (TW) ..... 94220401 U

(51) Int. Cl.
*H01R 13/648* (2006.01)
*H01R 13/625* (2006.01)

(52) U.S. Cl. ..... 439/607; 439/352

(58) Field of Classification Search ..... 439/352, 439/357, 358, 606, 607, 610
See application file for complete search history.

(56) References Cited

U.S. PATENT DOCUMENTS

| | | | | |
|---|---|---|---|---|
| 5,580,268 | A * | 12/1996 | Miyazawa | 439/352 |
| 6,276,965 | B1 * | 8/2001 | Madsen et al. | 439/607 |
| 6,827,610 | B1 * | 12/2004 | Lin | 439/607 |
| 6,863,545 | B1 * | 3/2005 | Peloza | 439/79 |
| 6,902,432 | B1 * | 6/2005 | Morikawa et al. | 439/607 |
| 2003/0157836 | A1 * | 8/2003 | Morikawa et al. | 439/607 |

* cited by examiner

*Primary Examiner*—James R. Harvey
(74) *Attorney, Agent, or Firm*—Rosenberg, Klein & Lee

(57) ABSTRACT

An electromagnetic interference diminishing structure of a connector assembly. The connector assembly includes a socket and a plug. The socket includes a main body enclosed by a metal housing connected to the grounding circuit of a circuit board. The plug includes a shield metal housing formed with grounding sections. A terminal main body is inserted in the shield metal housing. An insulating housing is fitted around the shield metal housing. When a front section of the plug is plugged into the socket, the metal housing of the socket and the grounding sections of the shield metal housing of the plug contact with each other through the holes of the insulating housing of the plug. Accordingly, the electromagnetic interference can be effectively diminished.

8 Claims, 8 Drawing Sheets

ELECTROMAGNETIC INTERFERENCE DIMINISHING STRUCTURE OF A CONNECTOR ASSEMBLY

BACKGROUND OF THE INVENTION

1. Field of the Invention

The present invention is related to an electromagnetic interference diminishing structure of a connector assembly.

2. Description of the Prior Art

The shield metal housing of the plug is formed with grounding sections respectively aligned with corresponding holes of the insulting housing enclosing the shield metal housing. When a front section of the plug is plugged into the socket, the metal housing of the socket and the grounding sections of the shield metal housing of the plug contact with each other through the holes of the insulating housing of the plug. Therefore, the induced electromagnetic wave of the shield metal housing of the plug can be grounded and diminished through the grounding circuit of the circuit board connected with the socket. Accordingly, the electromagnetic interference can be effectively diminished.

FIGS. 9 to 11 show an existent connector assembly such as P1394b-9pin connector assembly. The connector unit includes a socket 50 and a plug 60. The socket 50 has a main body 51 in which multiple terminals are inlaid. The main body 51 is enclosed by a metal housing 52. The main body 51 and the metal housing 52 define therebetween an insertion cavity 53. The plug 60 includes a shield metal housing 61 in which a terminal main body 62 is inserted. An insulating housing 63 is fitted around the shield metal housing 61. After the terminals in the terminal main body 62 are respectively connected with the leads, the rear section of the insulating housing 63 is wrapped with an insulating layer 64 by way of injection.

The terminal main body 62 is enclosed by the shield metal housing 61 for reducing the electromagnetic wave generated by the terminals when transmitting signals or shielding the terminals from external electromagnetic interference. Such measure works under low frequency, for example, below 800 MHz. However, the current signal transmission frequency is often up to 1.6 GHz or even over 3.2 GHz. Under such circumstance, the shield metal housing 61 enclosing the terminal main body 62 can simply partially reduce the electromagnetic interference. Moreover, in the case that the transmission frequency is further enhanced, the shield metal housing 61 can hardly diminish the electromagnetic interference.

SUMMARY OF THE INVENTION

It is therefore a primary object of the present invention to provide an electromagnetic interference diminishing structure of a connector assembly. The connector assembly includes a socket and a plug. The socket includes a main body in which multiple terminals are inlaid. The main body is enclosed by a metal housing connected to the grounding circuit of a circuit board. The main body and the metal housing define therebetween an insertion cavity. The plug includes a shield metal housing having a receiving room in which a terminal main body is inserted. An insulating housing is fitted around the shield metal housing, whereby after the terminals in the terminal main body are respectively connected with the leads, a rear section of the insulating housing is wrapped with an insulating layer by way of injection. The shield metal housing of the plug is formed with grounding sections respectively aligned with corresponding holes of the insulting housing. When a front section of the plug is plugged into the insertion cavity of the socket, the metal housing of the socket and the grounding sections of the shield metal housing of the plug contact with each other through the holes of the insulating housing of the plug. Therefore, the induced electromagnetic wave of the shield metal housing of the plug can be grounded and diminished through the grounding circuit of the circuit board connected with the socket. Accordingly, the electromagnetic interference can be effectively diminished.

It is a further object of the present invention to provide the above electromagnetic interference diminishing structure of the connector assembly, in which the shield metal housing of the plug is formed with multiple grounding sections for contacting with multiple sections of the metal housing of the socket. One end of the grounding section of the shield metal housing of the plug is a free end, whereby the grounding section is a resilient tongue for resiliently abutting against the metal housing of the socket.

The present invention can be best understood through the following description and accompanying drawings wherein:

DETAILED DESCRIPTION OF THE PREFERRED EMBODIMENTS

Figure 1:
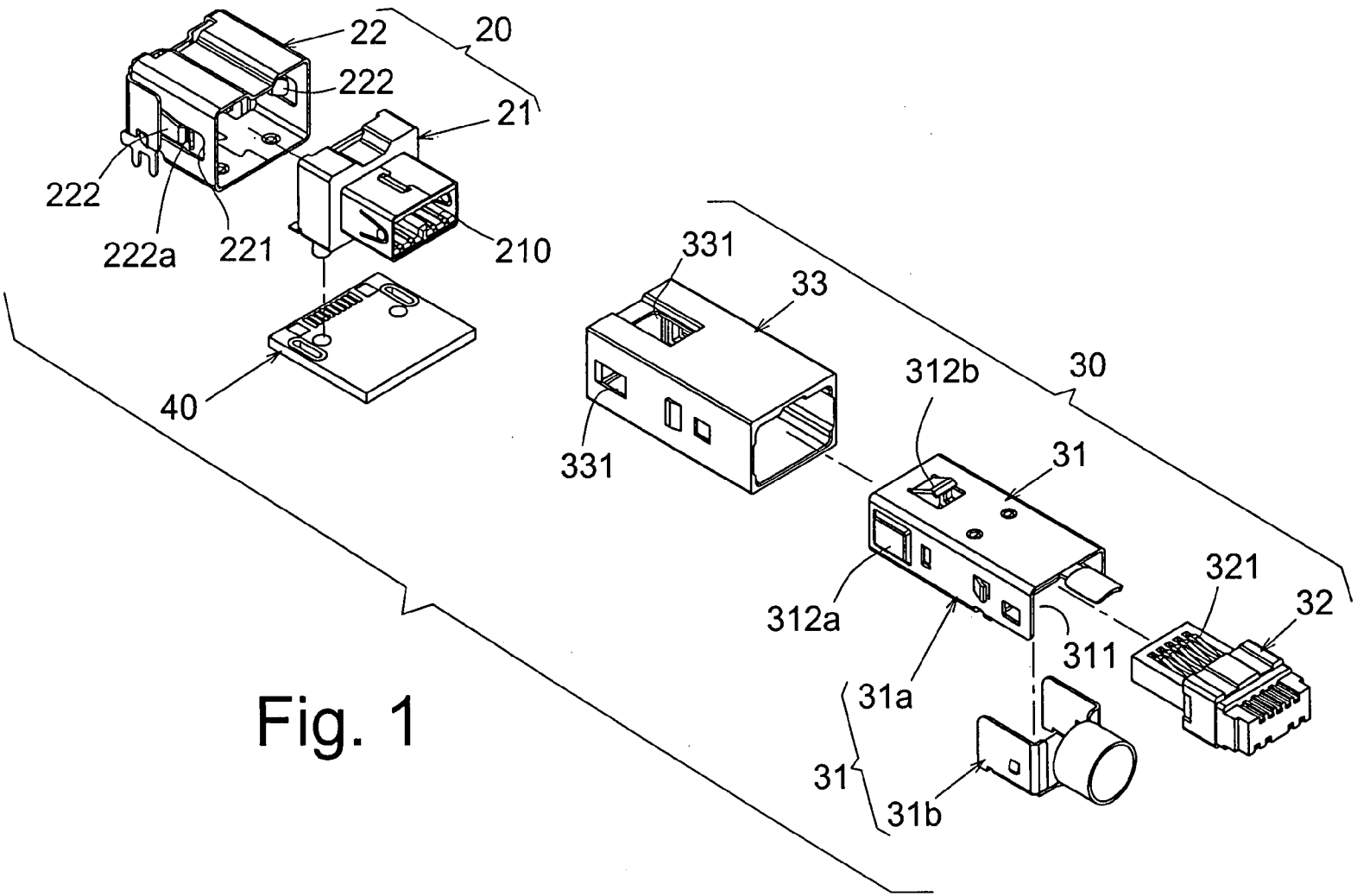
FIG. 1 is a perspective exploded view of the present invention.

Please refer to FIGS. 1 to 8. The present invention is related to an electromagnetic interference diminishing structure of a connector assembly. The connector assembly includes a socket 20 and a plug 30. The socket 20 has a main body 21 in which multiple terminals 210 are inlaid. The main body 21 is enclosed by a metal housing 22 connected to the grounding circuit of a circuit board 40. The main body 21 and the metal housing 22 define therebetween an insertion cavity 23. The plug 30 includes a shield metal housing 31 having a receiving room 311 in which a terminal main body 32 is inserted. An insulating housing 33 is fitted around the shield metal housing 31. After the terminals 321 in the terminal main body 32 are respectively connected with the leads, the rear section of the insulating housing 33 is wrapped with an insulating layer 34 by way of injection. The shield metal housing 31 of the plug 30 is formed with grounding sections 312*a* and 312*b* or 312*c* aligned with corresponding holes 331 of the insulting housing 33. When the front section of the plug 30 is plugged into the insertion cavity 23 of the socket 20, the metal housing 22 of the socket 20 and the grounding sections 312*a* and 312*b* or 312*c* of the shield metal housing 31 of the plug 30 contact with each other through the holes 331 of the insulating housing 33 of the plug 30. Accordingly, the induced electromagnetic wave of the shield metal housing 31 of the plug 30 can be grounded and diminished through the grounding circuit of the circuit board 40 connected with the socket 20. Therefore, the electromagnetic interference (EMI) can be effectively diminished.

The electromagnetic interference diminishing structure of the present invention is applicable to an electronic connector assembly such as P1394b-9pin electronic connector assembly or any other equivalent electronic connector.

Referring to FIGS. 1 to 6, in the electromagnetic interference diminishing structure of the present invention, the metal housing 22 of the socket 20 is formed with perforations 221. A resilient contact tongue 222 integrally extends from a sidewall of each perforation 221 into the perforation 221. A rear section of each resilient contact tongue 222 is biased toward the main body 21 enclosed by the metal housing 22. In addition, the rear end of the resilient contact tongue 222 is bent to form a V-shaped bending section 222*a*. The V-shaped bending section 222*a* correspondingly extends into the hole 331 of the insulating housing 33 of the plug 30 to resiliently tightly abut against the grounding section 312*a* of the shield metal housing 31.

In the electromagnetic interference diminishing structure of the present invention, the shield metal housing 31 of the plug 30 can be composed of a first casing 31*a* and a second casing 31*b* mated with each other. Alternatively, the shield metal housing 31 can be made from one piece of metal board by integral punching. This is not limited in the present invention.

Figure 4:
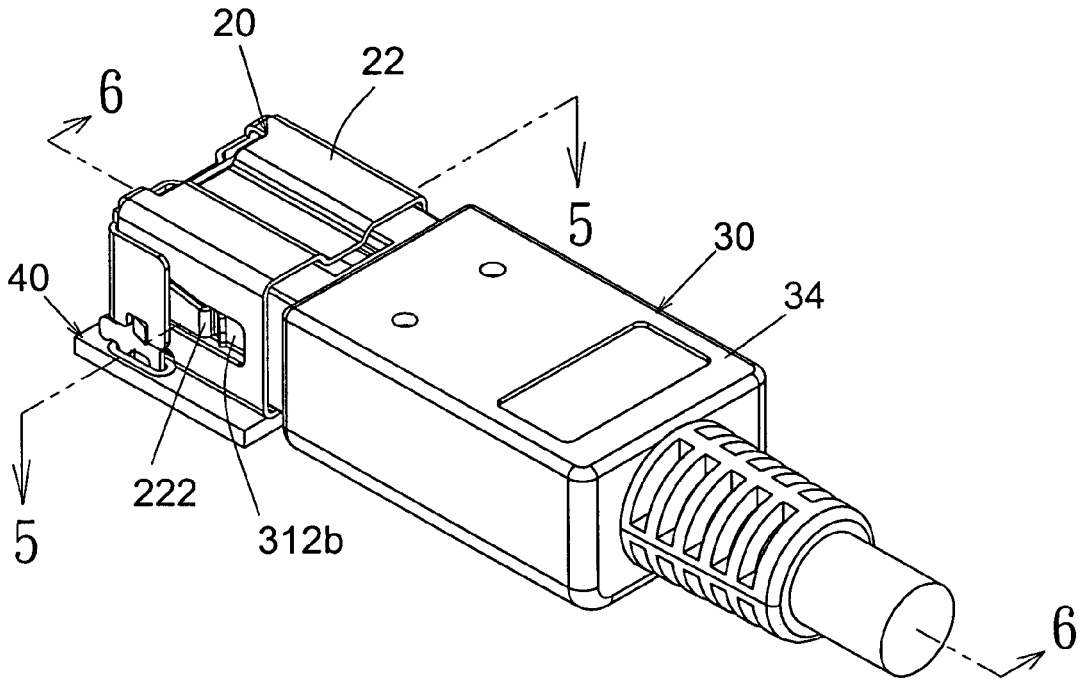
FIG. 4 is a perspective view showing that the plug of the present invention is plugged into the socket.
Figure 5:
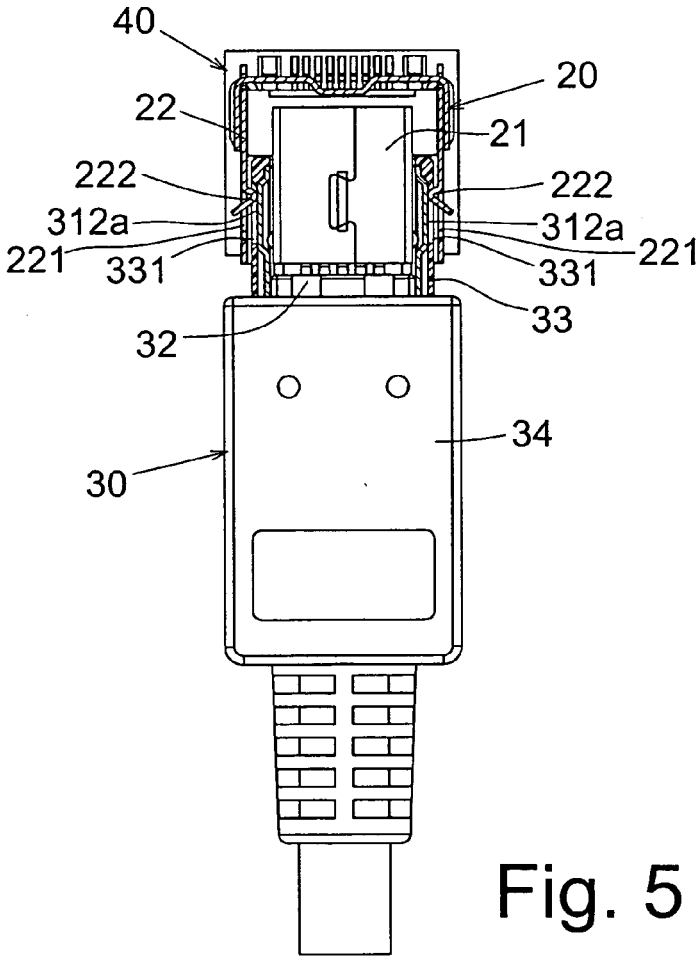
FIG. 5 is a sectional view taken along line 5—5 of FIG. 4.

Referring to FIGS. 1, 4 and 5, at least one sidewall of the front section of the shield metal housing 31 of the plug 30 is outward punched to form a boss section defined as a grounding section 312*a*. The grounding section 312*a* is aligned with the hole 331 of the insulating housing 33 or extends into the hole 331.

Figure 6:
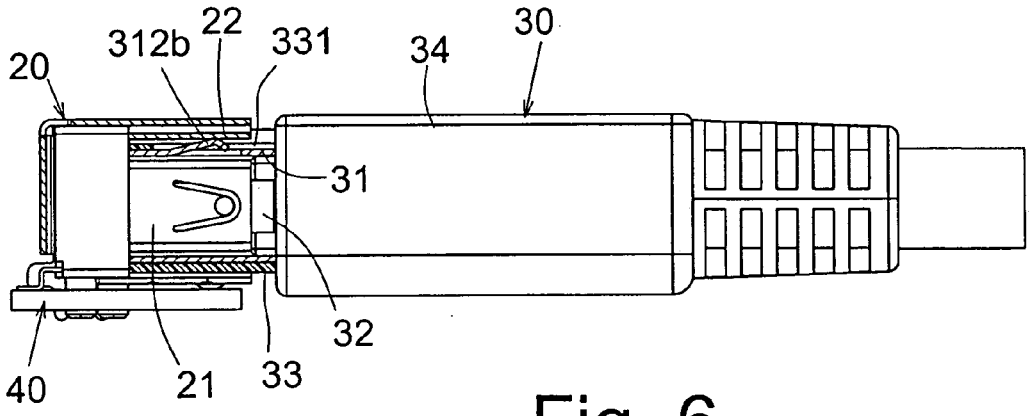
FIG. 6 is a sectional view taken along line 6—6 of FIG. 4.

Referring to FIGS. 1, 4 and 6, one end of the grounding section 312*b* of the shield metal housing 31 of the plug 30 is a free end, whereby the grounding section 312*b* is a resilient tongue for resiliently abutting against the metal housing 22 of the socket 20.

Figure 2:
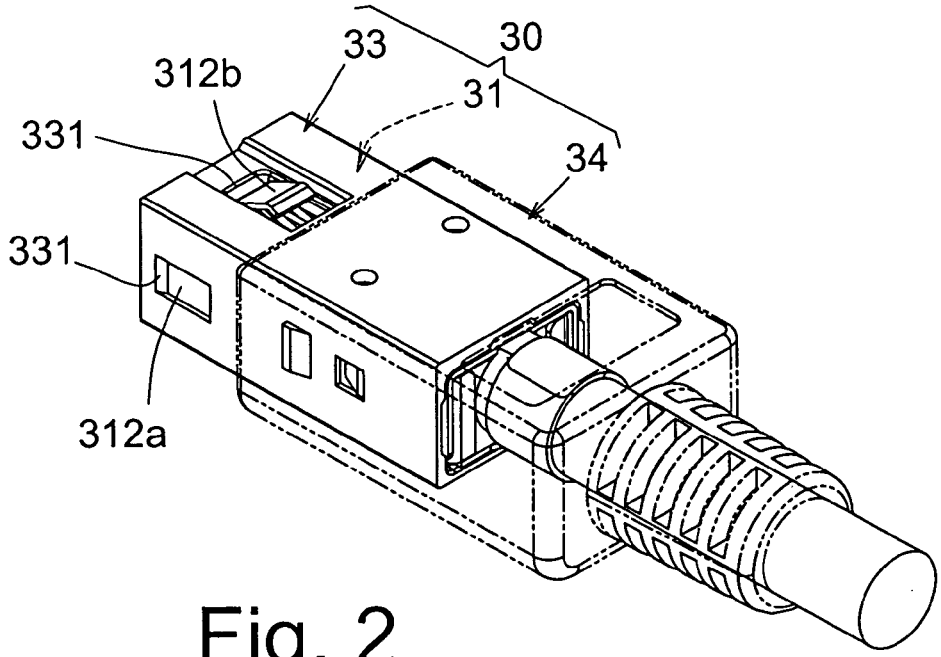
FIG. 2 is a partially perspective view of the plug of the present invention.
Figure 3:
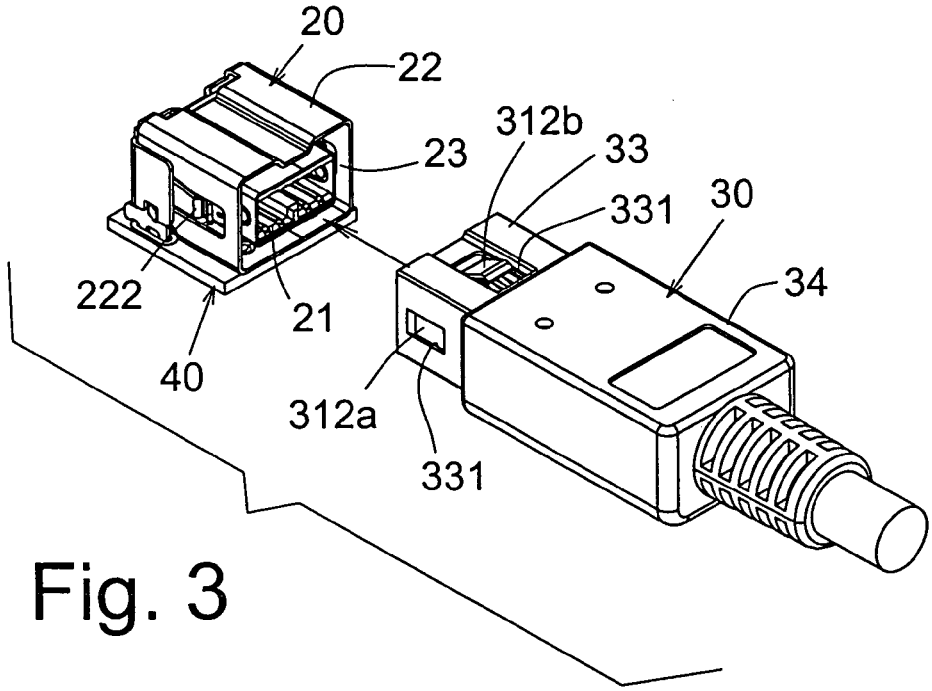
FIG. 3 is a perspective view showing that the socket and the plug of the present invention are separated from each other.
Figure 7:
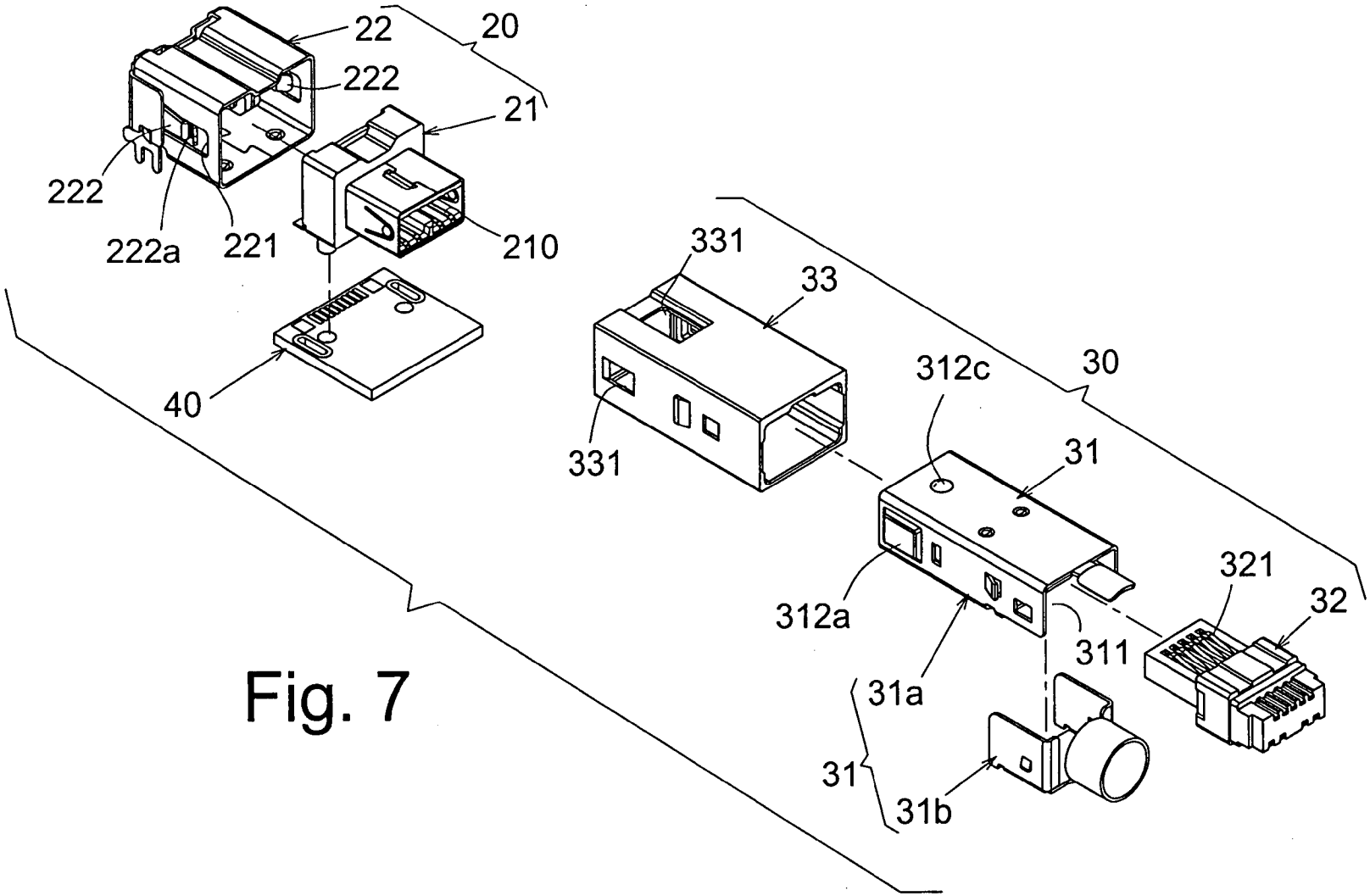
FIG. 7 is a perspective exploded view of another embodiment of the present invention.
Figure 8:
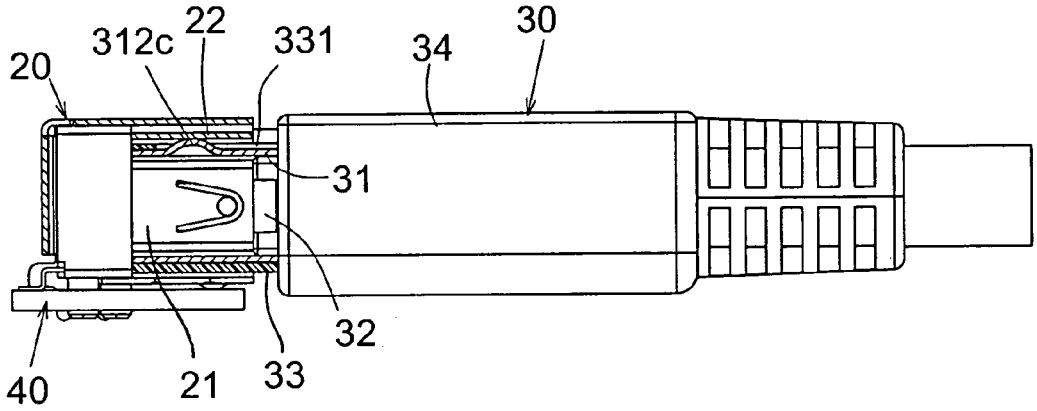
FIG. 8 is a sectional assembled view according to FIG. 7.
Figure 9:
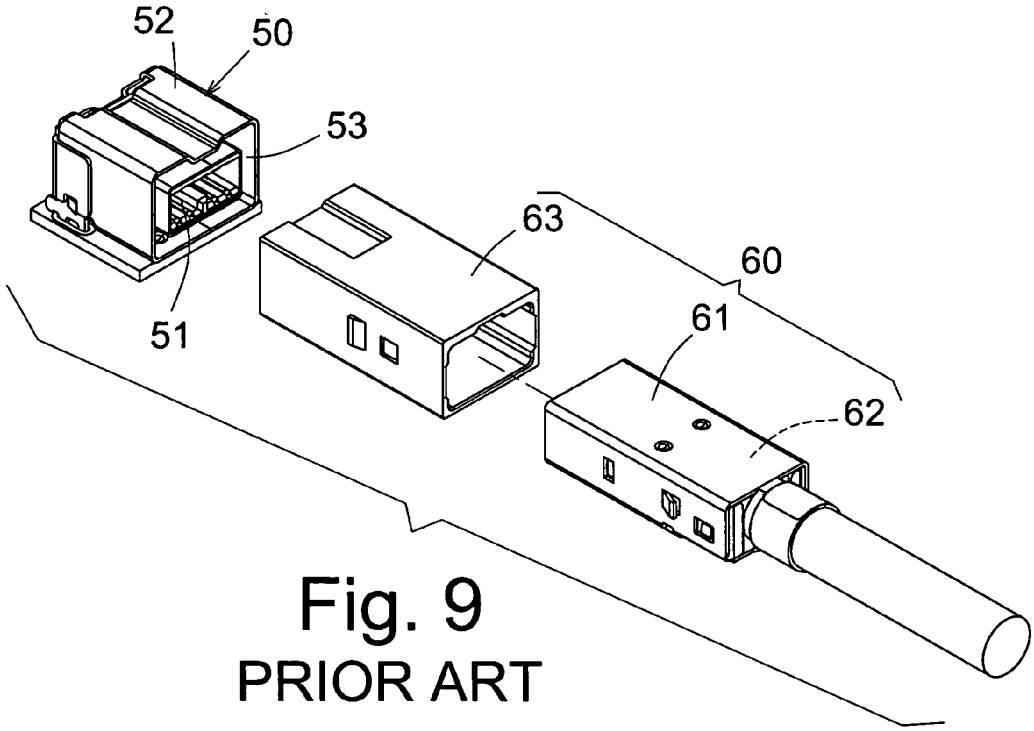
Fig. 9 PRIOR ART
FIG. 9 is a perspective exploded view of a conventional connector assembly.
Figure 10:
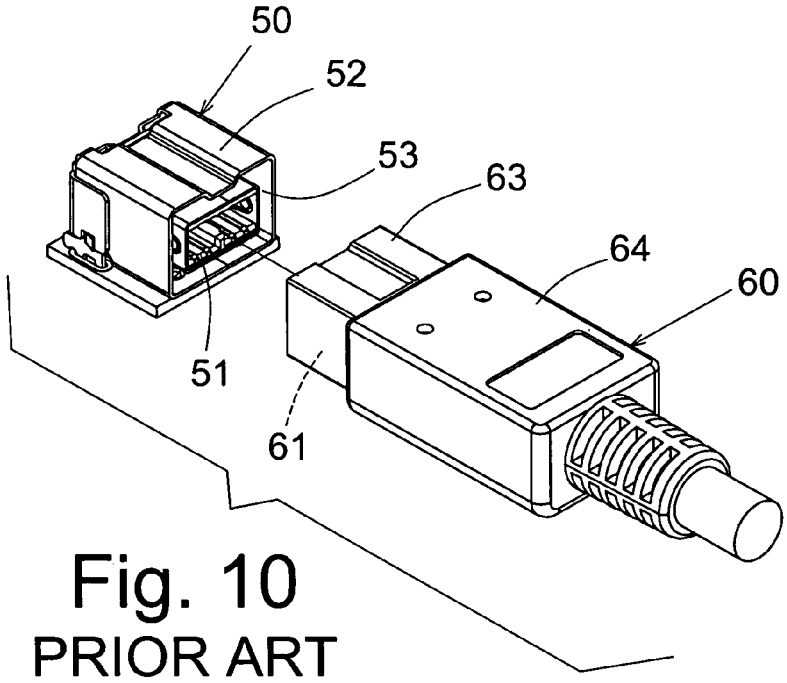
Fig. 10 PRIOR ART
FIG. 10 is a perspective view of the conventional connector assembly, in which the plug is separated from the socket.
Figure 11:
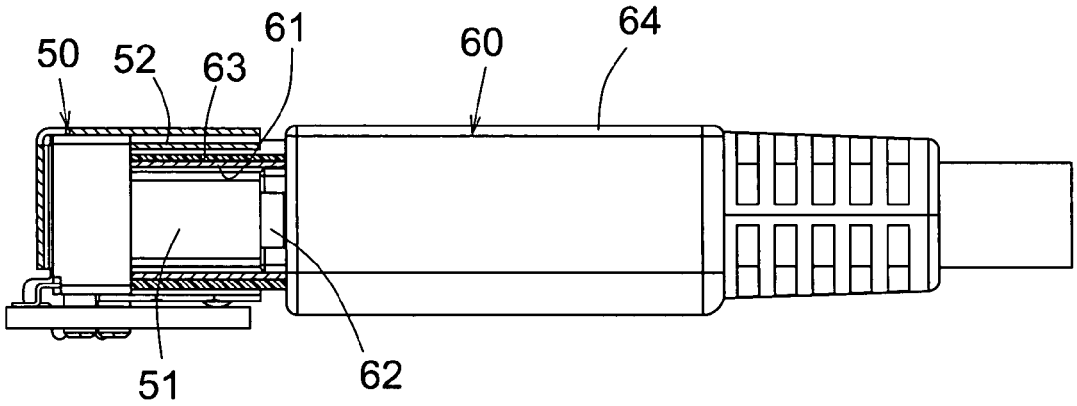
Fig. 11 PRIOR ART
FIG. 11 is a partially sectional view of the conventional connector assembly, in which the plug is plugged into the socket.

As shown in FIGS. 1 and 2, the grounding sections 312*a*, 312*b* of the shield metal housing 31 of the plug 30 are respectively a fixed grounding section 312*a* as a rectangular boss and a resilient tongue 312*b*. Alternatively, as shown in FIGS. 7 and 8, the grounding section 312*c* of the shield metal housing 31 of the plug 30 is a domed boss. The shape and pattern of the grounding sections 312*a*, 312*b*, 312*c* are not limited.

At least one grounding section 312*a*, 312*b*, 312*c* is formed on the shield metal housing 31 of the plug 30. The grounding sections 312*a*, 312*b*, 312*c* are respectively aligned with the holes 331 of the insulating housing 33 around the shield metal housing 31 or outward extend through the holes 331 of the insulating housing 33. When the plug 30 is plugged into the socket 20, the grounding section 312*a* protruding from the insulating housing 33 will contact with the metal housing 22 of the socket 20. Also, the resilient tongue 222 of the socket 20 will contact with the grounding section 312*b* of the shield metal housing 31 through the corresponding hole 331 of the insulating housing 33. Accordingly, the shield metal housing 31 of the plug 30 can connect with the grounding circuit connected with the socket 20. Therefore, the induced electromagnetic wave of the shield metal housing 31 of the plug 30 can be grounded and diminished through the grounding circuit of the circuit board 40 connected with the socket 20. Therefore, the electromagnetic interference (EMI) can be effectively diminished to stabilize the transmission of electronic signal of the connector assembly.

The above embodiments are only used to illustrate the present invention, not intended to limit the scope thereof. Many modifications of the above embodiments can be made without departing from the spirit of the present invention.

What is claimed is:

1. An electromagnetic interference diminishing structure of a connector assembly, the connector assembly including a socket and a plug, the socket including a main body in which multiple terminals are inlaid, the main body being enclosed by a metal housing connected to the grounding circuit of a circuit board, the main body and the metal housing defining therebetween an insertion cavity, the plug including a shield metal housing having a receiving room in which a terminal main body is inserted, an insulating housing being fitted around the shield metal housing, whereby after terminals in the terminal main body are respectively connected with leads, a rear section of the insulating housing is wrapped with an insulating layer by way of injection, said electromagnetic interference diminishing structure being characterized in that the shield metal housing of the plug is formed with grounding sections respectively aligned with corresponding holes of the insulting housing, whereby when a front section of the plug is plugged into the insertion cavity of the socket, the metal housing of the socket and the grounding sections of the shield metal housing of the plug contact with each other through the holes of the insulating housing of the plug.

2. The electromagnetic interference diminishing structure of a connector assembly as claimed in claim 1, wherein the metal housing of the socket is formed with perforations, a resilient contact tongue integrally extending from a sidewall of each perforation into the perforation, a rear section of each resilient contact tongue being biased toward the main body enclosed by the metal housing.

3. The electromagnetic interference diminishing structure of a connector assembly as claimed in claim 1, wherein the rear end of the resilient contact tongue is bent to form a V-shaped bending section.

4. The electromagnetic interference diminishing structure of a connector assembly as claimed in claim 1, wherein at least one sidewall of the front section of the shield metal housing of the plug is outward punched to form a boss section defined as a grounding section, the grounding section being aligned with one of the holes of the insulating housing or extending into the hole.

5. The electromagnetic interference diminishing structure of a connector assembly as claimed in claim 1, wherein one end of the grounding section of the shield metal housing of the plug is a free end, whereby the grounding section is a resilient tongue.

6. The electromagnetic interference diminishing structure of a connector assembly as claimed in claim 1, wherein the grounding section of the shield metal housing of the plug is a fixed grounding section as a rectangular boss.

7. The electromagnetic interference diminishing structure of a connector assembly as claimed in claim 1, wherein the grounding section of the shield metal housing of the plug is a domed boss.

8. The electromagnetic interference diminishing structure of a connector assembly as claimed in claim 1, wherein the shield metal housing of the plug is formed with multiple grounding sections respectively aligned with corresponding holes of the insulting housing.

* * * * *